US007896083B2

(12) United States Patent
Vickery

(10) Patent No.: US 7,896,083 B2
(45) Date of Patent: Mar. 1, 2011

(54) PIVOTED RAIL-BASED ASSEMBLY AND TRANSPORT SYSTEM FOR WELL-HEAD EQUIPMENT

(76) Inventor: James Raymond Vickery, Diana, TX (US)

( * ) Notice: Subject to any disclaimer, the term of this patent is extended or adjusted under 35 U.S.C. 154(b) by 0 days.

(21) Appl. No.: 12/286,630

(22) Filed: Oct. 1, 2008

(65) Prior Publication Data

US 2009/0095465 A1 Apr. 16, 2009

Related U.S. Application Data

(60) Provisional application No. 60/998,775, filed on Oct. 15, 2007.

(51) Int. Cl.
*E21B 33/06* (2006.01)

(52) U.S. Cl. ..... 166/379; 166/85.4

(58) Field of Classification Search ..... 166/75.11, 166/79.1, 85.1, 85.4, 85.5, 379; 414/332
See application file for complete search history.

(56) References Cited

U.S. PATENT DOCUMENTS 1,758,453 A * 5/1930 Mays ..... 166/79.1
2,300,763 A 11/1942 Athy
2,617,500 A 11/1952 Cardwell et al.
2,787,342 A 4/1957 Jenkins et al.
2,829,741 A 4/1958 Selberg et al.
2,993,570 A 7/1961 Bender
3,136,394 A 6/1964 Woolslayer et al.
3,658,270 A * 4/1972 Slator et al. ..... 242/390.2
3,942,593 A 3/1976 Reeve, Jr. et al.
4,021,978 A 5/1977 Busse et al.
4,290,495 A 9/1981 Elliston
4,359,089 A * 11/1982 Strate et al. ..... 166/79.1
4,491,006 A 1/1985 Ginzburg et al.
5,842,530 A 12/1998 Smith et al.
6,003,598 A 12/1999 Andreychuk
6,530,432 B2 3/2003 Gipson
6,634,436 B1 10/2003 Desai
6,860,337 B1 3/2005 Orr et al.
6,902,007 B1 * 6/2005 Orr et al. ..... 166/379
6,973,979 B2 12/2005 Carriere et al.
7,040,411 B2 * 5/2006 Kainer et al. ..... 166/379
7,086,474 B1 * 8/2006 Trevithick et al. ..... 166/379
7,111,689 B2 9/2006 Wise et al.

(Continued)

*Primary Examiner*—Kenneth Thompson
*Assistant Examiner*—Blake Michener
(74) *Attorney, Agent, or Firm*—Hemingway & Hansen, LLP; D. Scott Hemingway

(57) ABSTRACT

A stable vertical lift structure that raises pre-assembled equipment with flexibility in the positioning in relation to the well head location. The invention includes pre-assembled drilling and well-head equipment, such as a blow-out preventer and a stripper assembly supported by a vertical support structure, all of which is transported to the drilling site on a trailer assembly. The pivot point for the pre-assembled equipment is placed on a rail transport mounted on the trailer assembly, and the pivot point is laterally pushed to a locking point on the rail assembly before the pre-assembled equipment is vertically raised to its vertical alignment near the well head. After being raised to its vertical alignment position, the pre-assembled equipment can be placed over the well head at the drilling site. By positioning the pre-assembled equipment using the rail transport, there is flexibility in positioning the trailer relative to the well head and the vertical alignment operation can be conducted with stability.

20 Claims, 6 Drawing Sheets

U.S. PATENT DOCUMENTS

| | | | |
|---|---|---|---|
| 7,152,677 | B2 | 12/2006 | Parlar et al. |
| 7,191,839 | B2 | 3/2007 | Carriere et al. |
| 7,306,055 | B2 | 12/2007 | Barnes |
| 7,308,953 | B2 | 12/2007 | Barnes |
| 7,357,616 | B2 | 4/2008 | Andrews et al. |
| 7,389,820 | B2 * | 6/2008 | Day ..... 166/379 |
| 2003/0098150 | A1 | 5/2003 | Andreychuk |
| 2006/0260844 | A1 | 11/2006 | Patton et al. |
| 2007/0125551 | A1 | 6/2007 | Havinga |
| 2007/0209791 | A1 | 9/2007 | Havinga |
| 2008/0066968 | A1 | 3/2008 | Landry |

* cited by examiner

PIVOTED RAIL-BASED ASSEMBLY AND TRANSPORT SYSTEM FOR WELL-HEAD EQUIPMENT

RELATED APPLICATION DATA

This application is related to Provisional Patent Application Ser. No. 60/998,775 filed on Oct. 15, 2007, and priority is claimed for this earlier filing under 35 U.S.C. §119(e). The Provisional Patent Application is also incorporated by reference into this utility patent application.

TECHNICAL FIELD OF THE INVENTION

A pivoted rail-based assembly and transport system of well-head equipment in the field of oil and gas exploration and drilling.

BACKGROUND OF THE INVENTION

Many present-day oil and gas exploration assemblies include equipment that is transported to the well head or drilling site. This equipment can include a blowout preventer, lubricator pipe, stripper assembly, and/or an injector head. A blowout preventer is sometimes called a "Christmas Tree," and an injector head is sometimes called a "Crow's Nest." Other equipment and derrick assemblies may also be assembled at the well head or drilling site, but the assembly process is usually conducted by having each piece of equipment lifted over other equipment by a crane prior to making the proper connections and attachments. This assembly process is very time consuming and labor intensive.

Single pivot oil derrick assemblies are shown in U.S. Pat. Nos. 6,003,598; 5,842,530; 4,290,495; 3,942,593; 3,136,394; 2,993,570, 2,829,741, 2,617,500 and 2,300,763. These assemblies erect the derrick structure to a vertical position using a single pivot point transport system. Single pivot transport assemblies require that the pivot point be extended to an end of the transport bed trailer, which increases the instability of the assembly apparatus during vertical alignment of the derrick assembly. These single pivot transport assemblies also reduce the ability to vertically aligned pre-assembled equipment, which must be assembled separately before or after the derrick assembly is raised to its vertical position. The pivot point being aligned with the end of the bed trailer also reduces the flexibility of the assembly structure by requiring that the end of the trailer be aligned with the well head at the drilling site. There is a need for a more stable vertical lift structure that raises pre-assembled equipment with increased flexibility in the positioning in relation to the well head location.

Some equipment assemblies are transported to the well head or drilling site on a flat-bed trailer, and vertically aligned using one or more hydraulic lift pistons or other lift devices. Such an assembly is shown in U.S. Patent Publication No. US 2008/00669968 for slant drilling, US 2007/0209791, US 2007/0125551, US 2006/0260844 (platform raised), and US 2003/0098150, as well as the assemblies shown in U.S. Pat. Nos. 7,357,616; 7,308,953; 7,306,055; 7,191,839; 7,111,689; 6,973,979; and 6,860,337.

These lift assemblies, however, often use the end of the trailer assembly as the pivot point for vertically raising the equipment, which increases the instability of the system during the vertical alignment process. Further, these lift assemblies often use a single pivot point for the vertical alignment process, which does not allow for increased flexibility for the positioning relative to the well head at the drilling site. Moreover, the lift assemblies do not appear to vertically align pre-assembled blowout preventers with other heavy equipment, which is quite difficult to vertically align based on the significant weight and elevated centers of gravity. There is a need for a more stable vertical lift structure that raises pre-assembled equipment with increased flexibility in the positioning in relation to the well head location.

SUMMARY OF THE INVENTION

The present invention provides a more stable vertical lift structure that raises pre-assembled equipment with increased flexibility in the positioning in relation to the well head location. The invention includes pre-assembled drilling and well-head equipment, such as a blow-out preventer, a lubricator and a stripper, supported by a vertical support structure, all of which is transported to the drilling site on a trailer assembly. The pivot point for the pre-assembled equipment is placed on a rail transport mounted on the trailer assembly, and the pivot point is laterally pushed to a locking point on the rail assembly before the pre-assembled equipment is vertically raised to its vertical alignment near the well head.

After being raised to its vertical alignment position, the pre-assembled equipment can be placed over the well head at the drilling site, which reduces the time needed for assembly of the equipment. Further, by positioning the pre-assembled equipment using the rail transport, there is greater flexibility in positioning the trailer relative to the well head and the vertical alignment operation can be conducted with increased stability compared to known oil and gas exploration transport assemblies.

BRIEF DESCRIPTION OF THE DRAWINGS

The objects and features of the invention will become more readily understood from the following detailed description and appended claims when read in conjunction with the accompanying drawings in which like numerals represent like elements and in which:

DETAILED DESCRIPTION OF THE PREFERRED EMBODIMENTS

Figure 1:
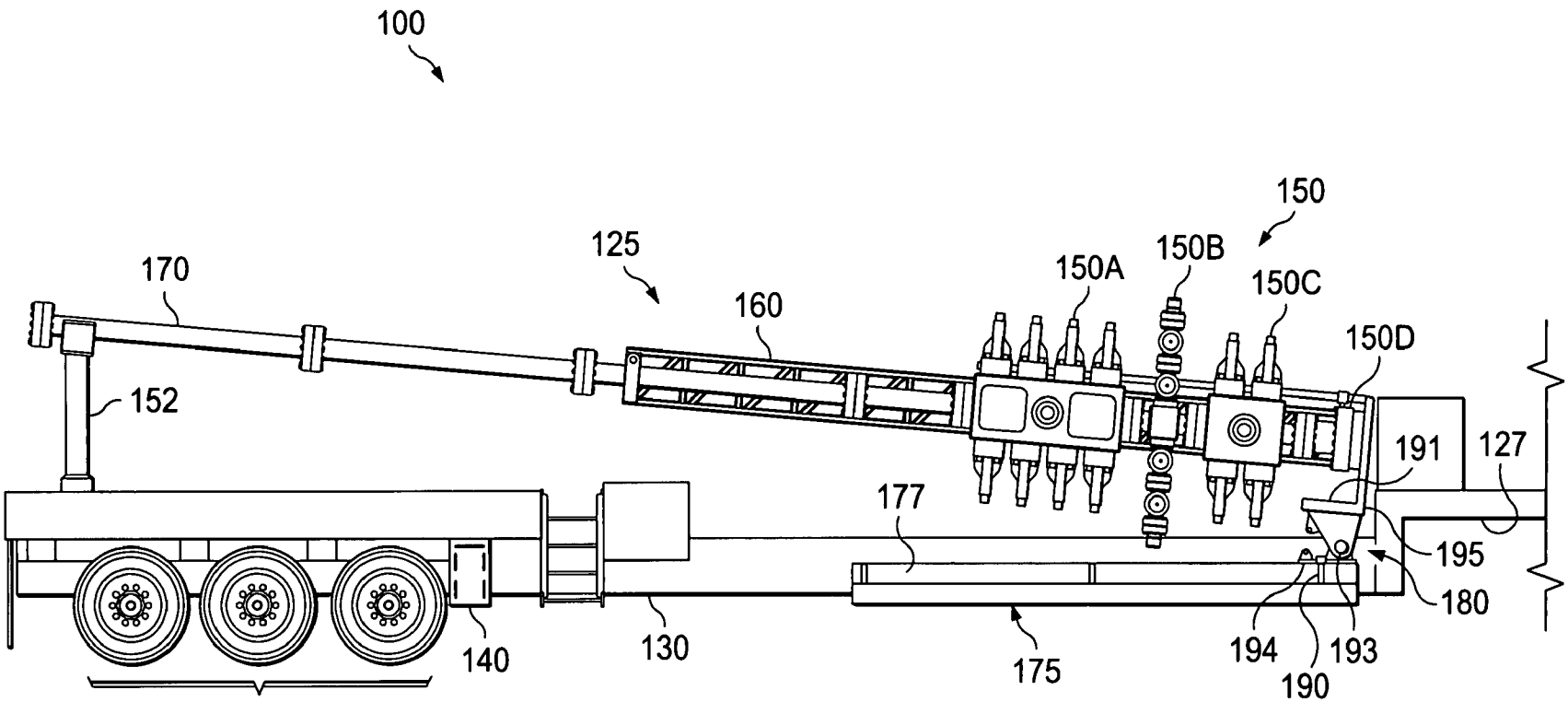
FIG. 1 is side view of the trailer.

FIG. 1 shows the crane trailer 100 having the pre-assembled equipment 125 loaded thereon, where the pre-assembled equipment 125 includes a blowout preventer 150 and stripper assembly 170 attached to a support frame 160. The crane trailer 100 has a hitch 127 for attachment to a tractor truck (not shown), a trailer bed 130 that runs the length of the trailer, and sets of wheels 135 at the end of the trailer for transport between drilling sites. Outriggers 140 are placed on the exterior quadrants of the crane trailer 100, and these outriggers are extended and placed in a secured contact with the ground when the pre-assembled equipment is moved on the crane trailer 100 to provide stability during the positioning operations. A crane (not shown) is used to assist the horizontal movement of the transfer cart 180 along the rail assembly 175 or the vertical movement of the pre-assembled equipment 125 and support frame 160.

The blowout preventer 150 (or Christmas Tree) can include blowout preventer valves 150A, a flow cross valve 150B, and a combo blowout preventer 150C for placement directly over the wellhead assembly at the drilling site. The test flange 150D is provided as part of the upper platform of the cart 180 so the blowout preventer assembly 150 can be pressure tested in the vertical or horizontal position prior to requiring actual installation on the well-head. This is a unique time saving aspect of the invention. A stripper assembly 170 or an injector head (not shown) can be attached to the end of the pre-assembled equipment 125. Put another way, a crows-nest box assembly called an "injector head" can be positioned and fastened to the top multistage pipes and a gooseneck (not shown) can also be positioned into the top of injector head 170. The present invention is described based on the insertion of coiled tubing or wire lines into a well head for a downhole application in an oil or gas well, but other equipment and elongated work-pieces are contemplated to be covered by the present invention.

The support frame 160 is attached to one or more pieces of the pre-assembled equipment 125 to provide support during the transition and positioning process. The support frame 160 also possesses an attachment pin hole 161 for positioning of a hydraulic cylinder and piston (not shown). As will be shown more clearly in a later figure, the support frame 160 is composed of a frame having longitudinal members 181, cross members 182, and cross brackets 183 to provide support against collapse when forces are applied to the support frame 160 during horizontal and vertical movement. Brackets and other support frames may be located on the trailer bed 130 to support the pre-assembled equipment 125 and support frame 160 during transport.

The crane trailer 100 has a rail assembly 175 longitudinally positioned along a bed portion 130A of the trailer bed 130. The rail assembly 175 is composed of two parallel rails 176 and 177 measuring approximately 8 to 20 feet, and allowing wheels 195 (not shown) on the lower platform 194 of the transfer cart 180 to roll longitudinally along a portion of the trailer bed 130. The length of the rails 176 and 177 could be shorter, as low as 4 to 5 feet, or as long as 30 to 35 feet depending on length of the trailer and the individual needs of the user. Opposing wheels 195 on either side of cart 180 and the rails 177 and 176 are positioned approximately 20 to 45 inches away from each other. The positioning and width may also be adjusted depending on the user's needs or the weight placed on the transfer cart 180. The transfer cart 180 or the support frame 160 can be moved laterally or vertically by a crane wench. These items may also be moved by a hydraulic piston positioned on the trailer bed 130. The end of the pre-assembled equipment 125 and support frame 160 rest in a secured position on the upper platform 191 of the trailer cart 180, which is pivotally mounted by a pivot eye joint 193 to the lower platform 194 of the trailer cart 180.

The transfer cart 180 will be described in more detail in a later figure, but drop pin placement holders 190 on the transfer cart 180 allow the transfer cart 180 to be securely fastened to pin placements 190A on the rails 176 and 177 of the transfer cart 180 at longitudinal positions A, B and C. Position A is the secured position for the transfer cart 180 during transport of the crane trailer 100 with the pre-assembled equipment 125 and support frame 160 positioned in a substantially horizontal or tiled position, Position B is the secured position when the pre-assembled equipment 125 and support frame 160 is transitioned between the substantially horizontal position to a vertical positioning (or vice versa), and Position C is the secured location where the vertically aligned pre-assembled equipment 125 is moved by a crane (not shown) between the rail assembly 175 on the trailer bed 130 and the wellhead.

Figure 2:
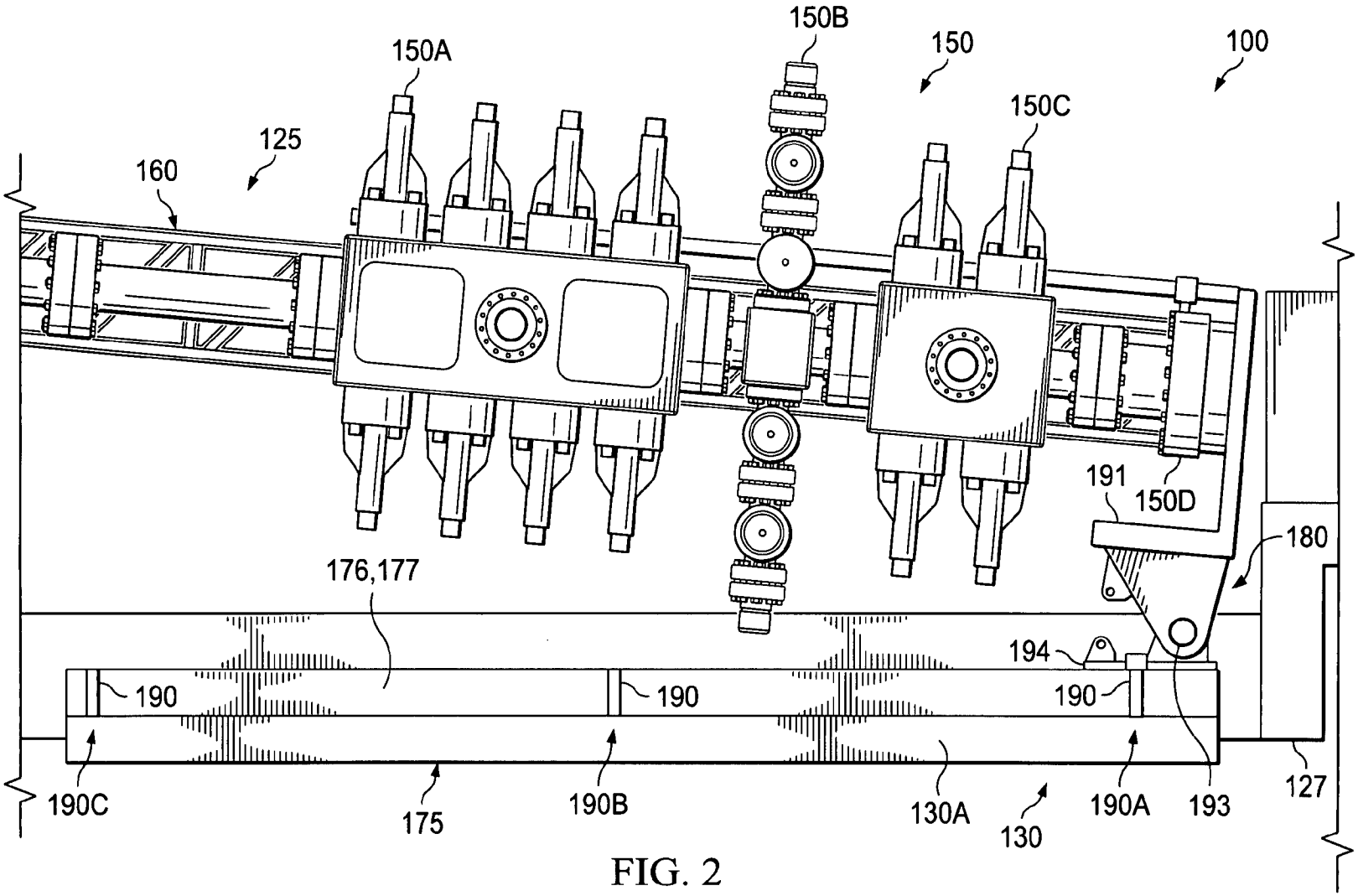
FIG. 2 is more detailed side view of the trailer.

FIG. 2 shows a portion of the crane trailer 100 with the rail assembly 175 longitudinally positioned along a bed portion 130A of the trailer bed 130. The rail assembly 175 is composed of two parallel rails 176 and 177 that allow wheels 195 (not shown) on the lower platform 194 of the transfer cart 180 to roll longitudinally along a portion of the trailer bed 130. The end of the pre-assembled equipment 125 and support frame 160 rest in a secured position on the upper platform 191 of the trailer cart 180, which is pivotally mounted by a pivot eye joint 193 to the lower platform 194 of the trailer cart 180.

As shown in greater detail in FIG. 2, the transfer cart 180 has drop pin placement holders 190 on the transfer cart 180 allow the transfer cart 180 to be securely fastened to pin placements 190A on the rails 176 and 177 of the transfer cart 180 at longitudinal positions A, B and C. Position A is the secured position for the transfer cart 180 during transport of the crane trailer 100 with the pre-assembled equipment 125 and support frame 160 positioned in a substantially horizontal or tiled position, where Position A is situated at one end of the rails 176 and 177. Position B is the secured position when the pre-assembled equipment 125 and support frame 160 is transitioned between the substantially horizontal position to a vertical positioning (or vice versa), which is approximately midway down rails 176 and 177. Position B could be any position on the rail after the cart 180 travels approximately five feet away position A to accommodate the spacing needed for the vertical positioning of the support assembly 160. Position C is the secured location where the vertically aligned pre-assembled equipment 125 is moved by a crane (not shown) between the rail assembly 175 on the trailer bed 130 and the wellhead, which is approximately 16-19 feet down the rails 176 and 177 on a twenty (20) foot rail length. These pin positions may change or be modified depending on the needs of the system and the situation encountered at the drilling site.

Figure 3:
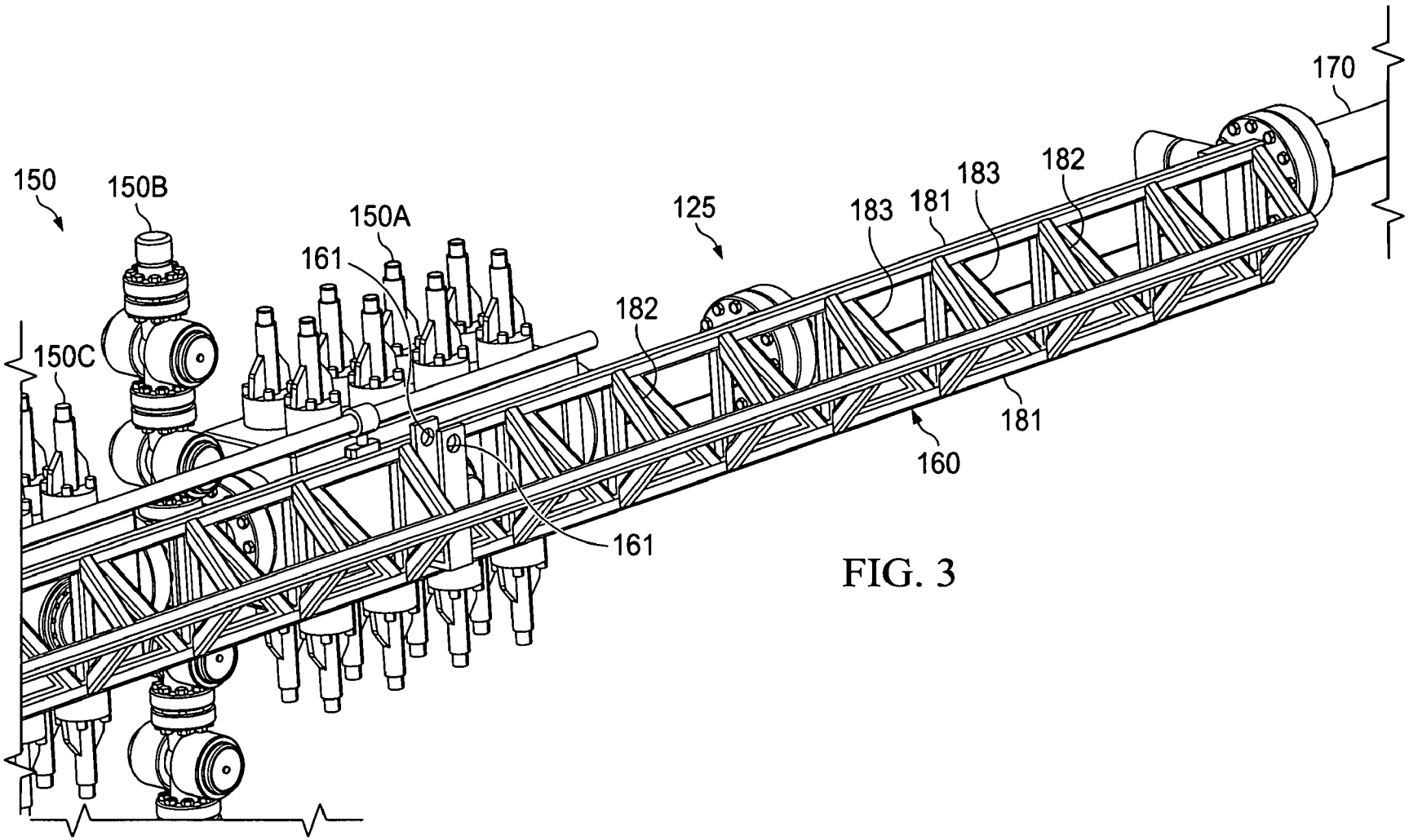
FIG. 3 is the back view of the support structure.

As shown in FIG. 3, pre-assembled combination of a blowout preventer (Christmas tree), lubricator pipe and stripper that is transported to a job site horizontally lying on the bed of a flat-bed trailer bed 100. (e.g. eighteen wheeler trailer). As shown in FIG. 3, the blowout preventer 150 (or Christmas Tree) can include blowout preventer valves 150A, a flow cross valve 150B, and a combo blowout preventer 150C for placement directly over the wellhead assembly at the drilling site. The test flange 150D (not shown) is provided as part of the upper platform of the cart 180 so the blowout preventer assembly 150 can be pressure tested in the vertical or horizontal position prior to requiring actual installation on the well-head. This is a unique time saving aspect of the invention. A stripper assembly 170 or an injector head (not shown) can be attached to the end of the pre-assembled equipment 125.

FIG. 3 also shows the support frame 160 which is attached to one or more pieces of the pre-assembled equipment 125 to provide support during the transition and positioning process. The support frame 160 also possesses an attachment pin hole 161 for positioning of a hydraulic cylinder and piston (not shown). The support frame 160 is composed of a frame having longitudinal members 181, cross members 182, and cross brackets 183 to provide support against collapse when forces are applied to the support frame 160 during horizontal and vertical movement.

Figure 4:
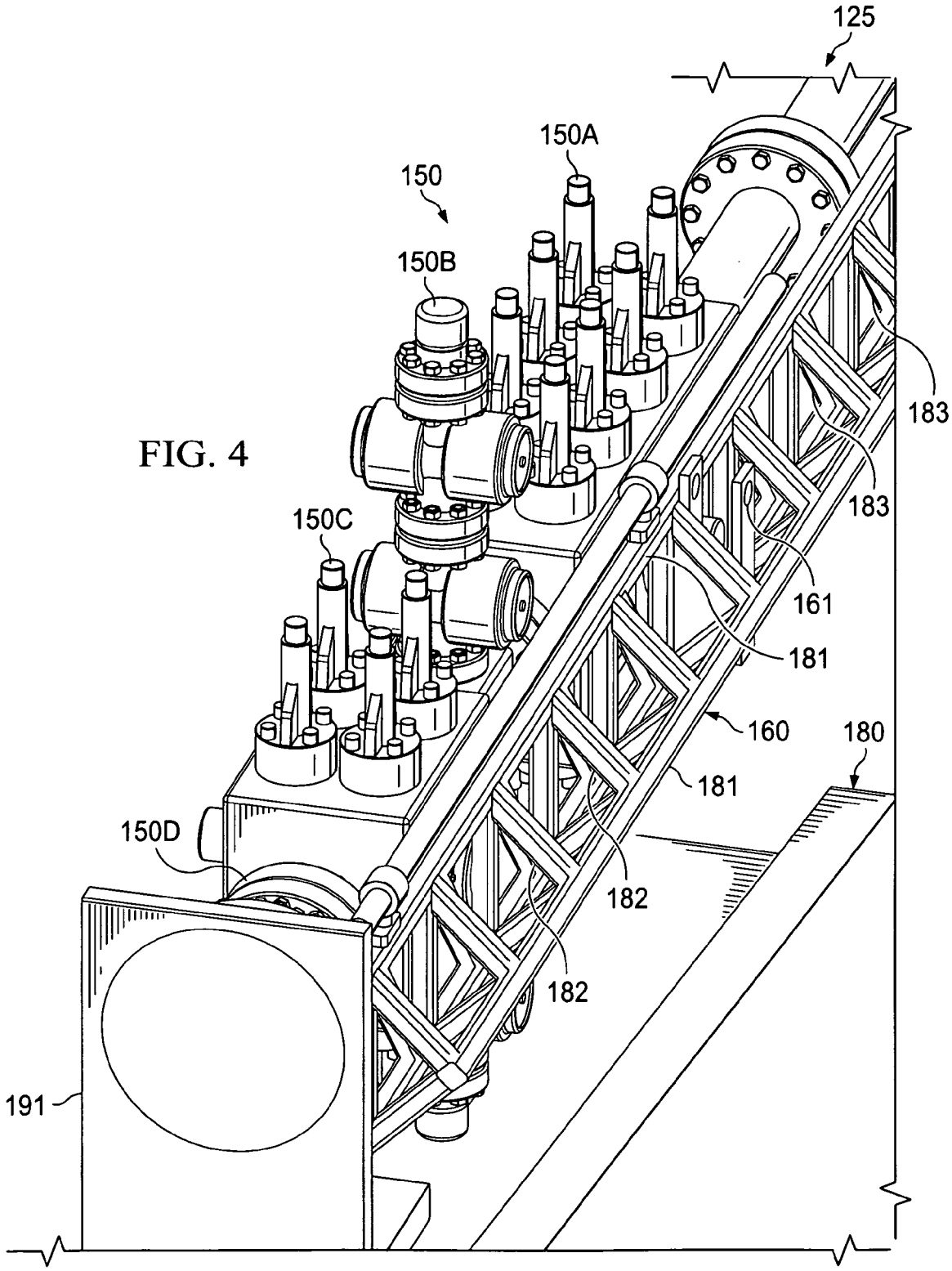
FIG. 4 is the top view of the pre-assembled equipment and the support structure.

FIG. 4 shows a portion of the crane trailer 100 with an end view of the support frame 160 and the pre-assembled equipment 125. The support frame 160 is composed of a frame having longitudinal members 181, cross members 182, and cross brackets 183 (not shown) to provide support against collapse when forces are applied to the support frame 160 during horizontal and vertical movement. The support frame 160 which is attached to one or more pieces of the pre-assembled equipment 125 to provide support during the transition and positioning process.

In FIG. 4, the support frame 160 also possesses an attachment pin hole 161 for positioning of a hydraulic cylinder and piston (not shown). As shown in FIG. 4, the blowout preventer 150 (or Christmas Tree) can include blowout preventer valves 150A (not shown), a flow cross valve 150B, and a combo blowout preventer 150C for placement directly over the well-head assembly at the drilling site. The test flange 150D (not shown) is provided as part of the upper platform of the cart 180 so the blowout preventer assembly 150 can be pressure tested in the vertical or horizontal position prior to requiring actual installation on the well-head. This is a unique time saving aspect of the invention. The end of the pre-assembled equipment 125 and support frame 160 rest in a secured position on the upper platform 191 of the trailer cart 180.

Figure 5:
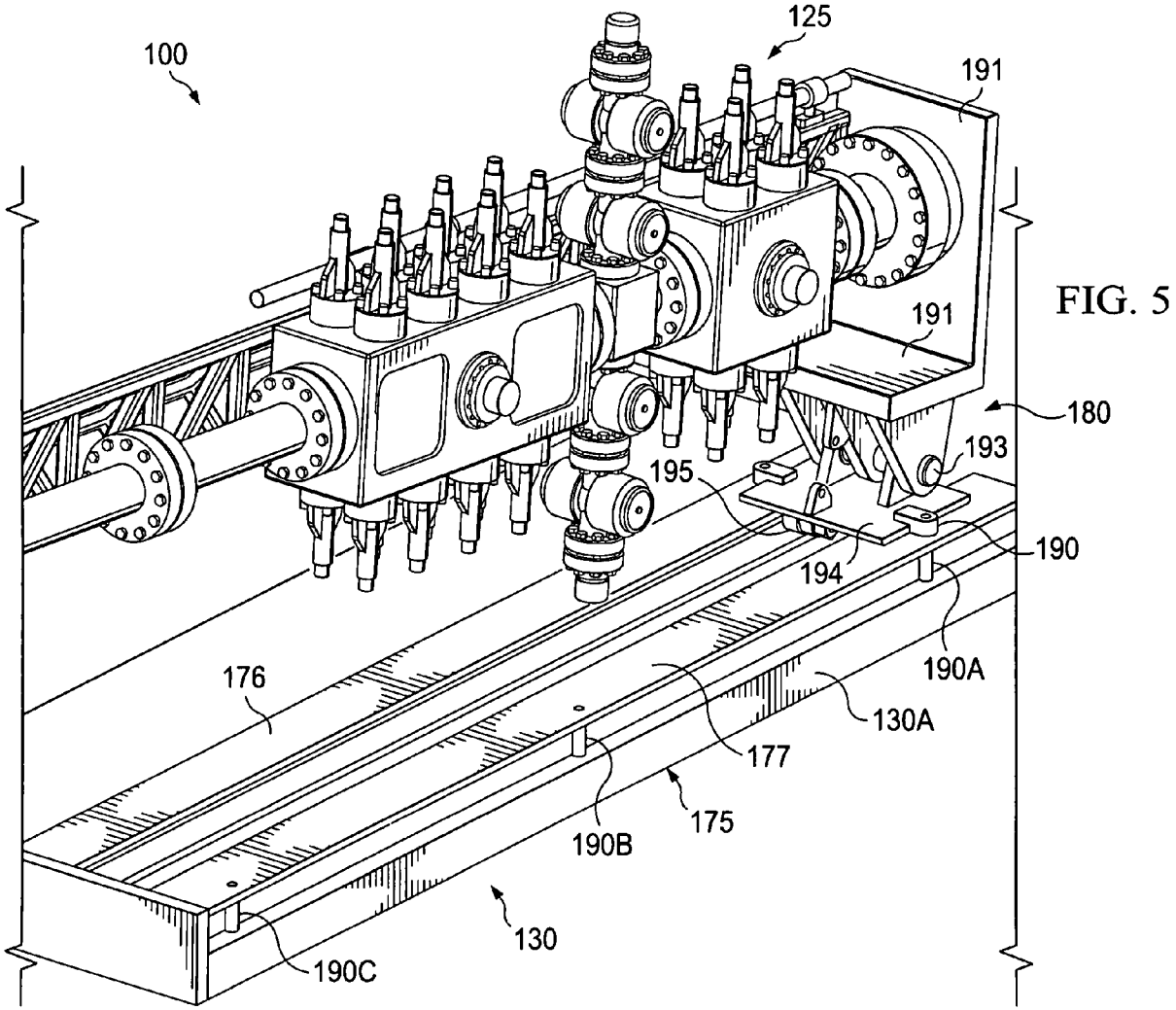
FIG. 5 is the top view of the rail assembly on the trailer bed.

As shown in FIG. 5, the crane trailer 100 has a rail assembly 175 longitudinally positioned along a bed portion 130A of the trailer bed 130. The rail assembly 175 is composed of two parallel rails 176 and 177 that allow wheels 195 on the lower platform 194 of the transfer cart 180 to roll longitudinally along a portion of the trailer bed 130. The end of the pre-assembled equipment 125 and support frame 160 rest in a secured position on the upper platform 191 of the trailer cart 180, which is pivotally mounted by a pivot eye joint 193 to the lower platform 194 of the trailer cart 180. For the transfer cart 180, drop pin placement holders 190 on the transfer cart 180 allow the transfer cart 180 to be securely fastened to pin placements 190A on the rails 176 and 177 of the transfer cart 180 at longitudinal positions A, B and C.

Position A is the secured position for the transfer cart 180 during transport of the crane trailer 100 with the pre-assembled equipment 125 and support frame 160 positioned in a substantially horizontal or tiled position, Position B is the secured position when the pre-assembled equipment 125 and support frame 160 is transitioned between the substantially horizontal position to a vertical positioning (or vice versa), and Position C is the secured location where the vertically aligned pre-assembled equipment 125 is moved by a crane (not shown) between the rail assembly 175 on the trailer bed 130 and the wellhead.

Figure 6:
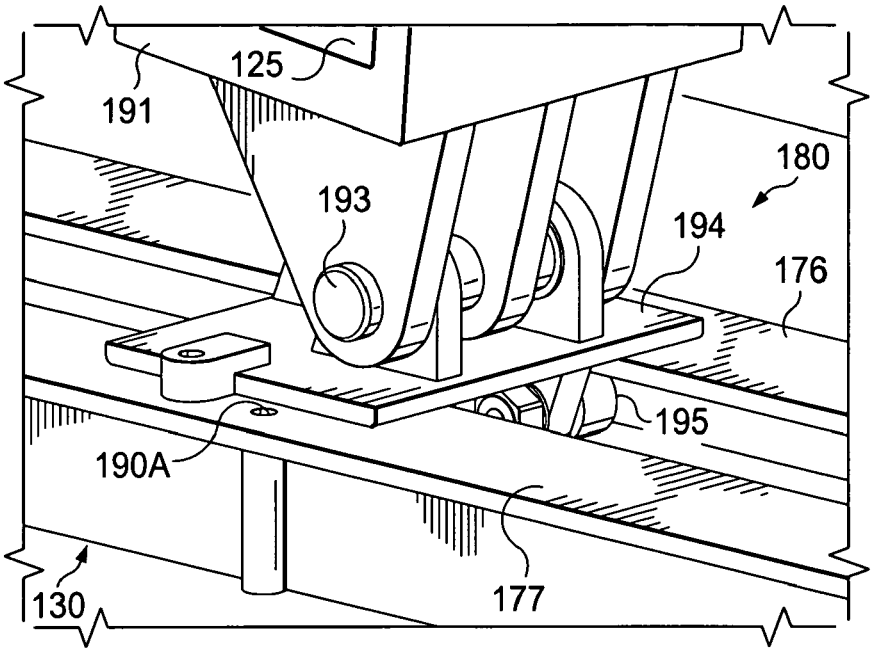
FIGS. 6 and 7 are a side view and front view, respectively, of the transfer cart positioned in the rail assembly.

As shown in FIG. 6, the upper platform 191 and the lower platform 194 of the transfer cart 180 to roll longitudinally along a portion of the trailer bed 130. The end of the pre-assembled equipment 125 and support frame 160 rest in a secured position on the upper platform 191 of the trailer cart 180, which is pivotally mounted by a pivot eye joint 193 to the lower platform 194 of the trailer cart 180. Preferably, the lower platform 194 is approximately 17 inches long and 24 inches wide, with pivot eye joints being of the type produced by Hub City Industrialine Bearing Units, Type E Tapered Roller Bearing Units, either Model EPB2 or EPB4. For the transfer cart 180, drop pin placement holders 190 on the transfer cart 180 allow the transfer cart 180 to be securely fastened to pin placements 190A on the rails 176 and 177 of the transfer cart 180 at various longitudinal positions. Position A is the secured position for the transfer cart 180 during transport of the crane trailer 100 with the pre-assembled equipment 125 and support frame 160 positioned in a substantially horizontal or tiled position.

Figure 7:
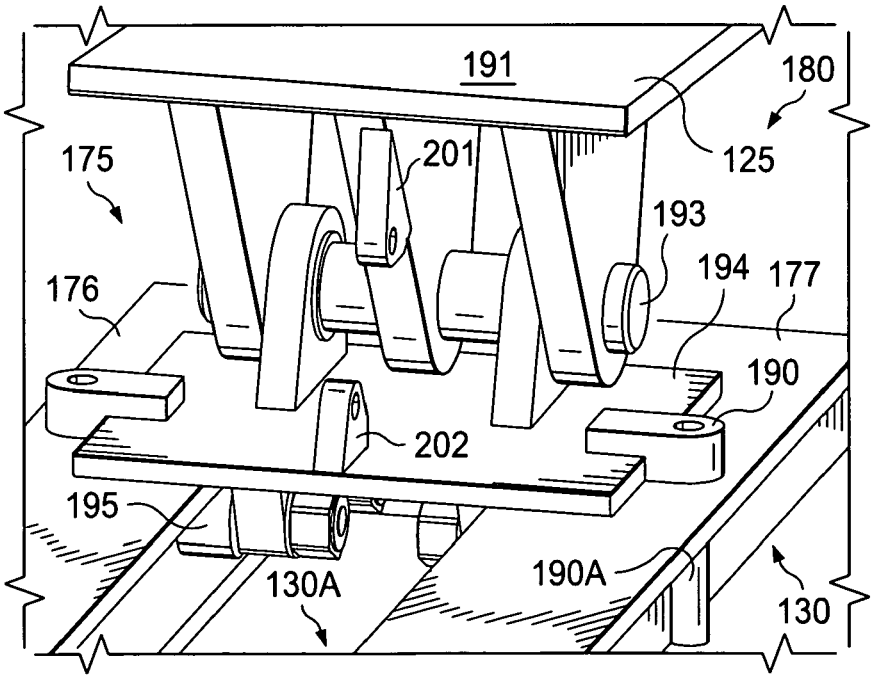

As shown in FIG. 7, the crane trailer 100 has a rail assembly 175 longitudinally positioned along a bed portion 130A of the trailer bed 130. The rail assembly 175 is composed of two parallel rails 176 and 177 that allow wheels 195 on the lower platform 194 of the transfer cart 180 to roll longitudinally along a portion of the trailer bed 130. The end of the pre-assembled equipment 125 and support frame 160 rest in a secured position on the upper platform 191 of the trailer cart 180, which is pivotally mounted by a pivot eye joint 193 to the lower platform 194 of the trailer cart 180. The wheels 195 have a flat profile, but guide wheels can be placed on the upper surface of the rails 176 and 177 and these guide wheels can roll along an angled iron track. These guide wheels can help maintain the exact alignment of the cart and frame relative to the railing.

For the transfer cart 180, drop pin placement holders 190 on the transfer cart 180 allow the transfer cart 180 to be securely fastened to pin placements 190A on the rails 176 and 177 of the transfer cart 180 at longitudinal positions A, B and C. Position A is the secured position for the transfer cart 180 during transport of the crane trailer 100 with the pre-assembled equipment 125 and support frame 160 positioned in a substantially horizontal or tiled position. Pin holes 201 and 202 allow the upper and lower platforms of the transfer cart 180 to be secured when the pre-assembled equipment 125 and the support frame 160 are vertically positioned.

The present invention allows the pre-assemble equipment 125 and support 160 to be vertically tilted upward and placed over the well head at the job site for subsequent use to insert coiled tubing, wire lines, or other elongated work pieces into a well head for a downhole application. Once vertically aligned and assembled with the gooseneck and injector head, the assembly is lifted off the trailer bed in its vertical alignment by the crane and set on top of the well head, where it is fastened thereto. The coiled tubing is run through the goose neck, into the injector head, down the pre-assembled stripper, lubricator pipe, and blow-out preventer, and then down into the well-head. The tilt up operation uses a crane assembly and the pivot point on the trailer bed to pull the upper part of the assembly into the air and tilt the pre-assembled devices into a vertical alignment using a pivot point on the trailer.

As known in the prior art, combined elements would normally be transported separately to the job site and assembled separately over the well head, which is an all-day job of 8-16 hours. By transporting theses devices in a pre-assembled arrangement and tilting the pre-assembled combination into vertical alignment at the job site, many hours of work time are saved. The assembly time at the job site is substantially reduced, which can result in increased safety, decreased work stoppages, and reduced accidents.

The present invention possesses several novel aspects, which include (but are not limited to) the following: (1) transporting the pre-assembled blow-out preventer, lubricator pipe and stripper on flat bed trailer (horizontally aligned) to the job site, (2) the vertical alignment of these pre-assembled elements using a moveable track, pivot assembly on the trailer bed, and one or more hydraulic pistons on the trailer bed (in combination with an overhead crane or by itself), (3) placing the vertically aligned assembly on top of the well-head with the crane, and (4) reversing the process after the job is completed. One could also use non-hydraulic piston assembly, such as a chain hoist or wench. Other minor modifications are within the scope of the invention.

Having described the invention, I claim:

1. A system for transporting pre-assembled well-head equipment near a well-head location, comprising:

a parallel set of two rail tracks located in a planar relation to a bed of a trailer, each track having a longitudinal axis that extends in parallel to each other;

a transfer cart having a lower platform having a planar surface that is oriented in parallel to the longitudinal axis of said set of two rails, two pairs of wheels mounted on said lower platform, a first pair of wheels axially disposed to each other and a second pair of wheels axially disposed to each other, and each pair of wheels mounted on the lower platform at a fixed distance from each other and each pair of wheels being engaged with said parallel set of rail tracks, an upper "L" shaped platform having a horizontal planar surface and a vertical surface, said upper platform being pivotally mounted at a single pivot joint connected to one end of the planar surface on the lower portion of the transfer cart, said upper portion of the transfer cart being moved rotationally at the pivot joint mounted on the lower portion of the cart;

a longitudinal support frame associated with said pre-assembled well-head equipment, said longitudinal support frame providing support to a pre-assembled equipment during movement of the equipment;

said horizontal planar surface of the upper platform of the transfer cart being engaged with the bottom of the pre-assembled well-head equipment to provide support to the pre-assembled equipment, said pre-assembled well-head equipment being positioned substantially horizontally on the trailer bed when being transported, and said preassembled well-head equipment being pivotally rotated around the pivot joint coupled to the transfer cart to place said pre-assembled well-head equipment and support frame in a substantial vertical alignment for placement on a well-head.

2. A system according to claim 1 further comprising a hydraulic piston that moves the transfer cart laterally along the rail track.

3. A system according to claim 1 wherein said lower portion of said transfer cart has pin-out placements for locking the transfer cart at one or more predetermined positions along the rail track.

4. A system according to claim 3 further comprising a hydraulic piston that moves the transfer cart laterally along the rail track.

5. A system according to claim 1 wherein said pre-assembled equipment placed on the platform of the transfer cart is tilted into a substantially horizontal position prior to being moved horizontally on the rail to said transport position.

6. A system according to claim 1 wherein said platform associated with the upper portion of the transfer cart includes a test flange for hydrostatic pressure testing of one or more gaskets and connections on the blow-out preventer and associated piping and valves on the pre-assembled equipment prior to installation on the well-head.

7. A system for positioning pre-assembled well-head equipment, comprising:

a transfer cart having an upper "L" shaped platform with a horizontal surface and a vertical surface, said horizontal surface engages the bottom of said pre-assembled well-head equipment attached to a support frame, said transfer cart having a lower platform having a horizontal planar surface, said lower platform being connected to the upper platform at a pivot joint located at one end said horizontal planar surface of the lower platform such that the upper platform is pivotally mounted to a lower platform of the transfer cart, said lower platform having a two sets of parallel aligned wheels positioned in pairs on the lower platform with each pair of wheels being located at a fixed distance relative to each other; and a parallel set of two rails mounted on a trailer bed, said two pairs of wheels of said lower platform of said transfer cart moving along said rails to position the transfer cart at different locations for vertical and horizontal positioning of said pre-assembled equipment.

8. A system according to claim 7 further comprising a hydraulic piston that moves the transfer cart laterally along the rail track.

9. A system according to claim 7 wherein said lower portion of said transfer cart has pin-out placements for locking the transfer cart at one or more predetermined positions along the rail track.

10. A system according to claim 9 further comprising a hydraulic piston that moves the transfer cart laterally along the rail track.

11. A system according to claim 7 wherein said pre-assembled equipment placed on the platform of the transfer cart is tilted into a substantially horizontal position prior to being moved horizontally on the rail to said transport position.

12. A system according to claim 7 wherein said upper platform associated with the transfer cart includes a test flange for hydrostatic pressure testing of pressure testing of one or more gaskets and connections on the blow-out preventer and associated piping and valves on the pre-assembled equipment.

13. A method for transporting pre-assembled well-head equipment, comprising the steps of:

providing a support frame that is attached to the pre-assembled equipment used in well-head operations;

positioning the bottom of said pre-assembled equipment on a horizontal planar section of an "L"-shaped upper platform of a transfer cart, said transfer cart having a lower platform with two pairs of wheels located a fixed distance from each pair of wheels, each wheel being engaged with a pair of rail tracks located on a trailer bed, said lower platform and upper platform of transfer cart being moved laterally on the rail due to movement of said wheels, said upper platform being pivotally mounted to the lower platform of the transfer cart at a pivot joint located at one end of the lower platform on the transfer cart;

moving said support frame and said pre-assembled equipment in a horizontal position during transport, moving said pre-assembled equipment horizontally on the rails of the trailer bed from a transport position to a position on said trailer bed that can accommodate pivoting the pre-assembled equipment into a vertical alignment position;

vertically pivoting said pre-assembled equipment by tilting the support frame and pre-assembled equipment placed on the upper platform around the pivot joint between the upper and lower platforms of the transfer cart to place pre-assembled equipment into a substantially vertical position;

moving the vertically-aligned support frame and pre-assembled equipment horizontally along the rails to a position relative to the well-head; and placing the support frame and pre-assembled equipment over the well-head.

14. A method according to claim 13 further comprising a hydraulic piston that moves the transfer cart laterally along the rail track.

15. A method according to claim 13 wherein said lower portion of said transfer cart has pin-out placements for locking the transfer cart at one or more predetermined positions along the rail track.

16. A method according to claim 15 further comprising a hydraulic piston that moves the transfer cart laterally along the rail track.

17. A method according to claim 13 wherein said pre-assembled equipment placed on the platform of the transfer cart is tilted into a substantially horizontal position prior to being moved horizontally on the rail to said transport position.

18. A method according to claim 17 wherein the preassembled equipment is orientated in a substantially horizontal alignment for mobile transport.

19. A method according to claim 13 wherein said platform associated with the upper portion of the transfer cart includes a test flange for hydrostatic pressure testing of one or more gaskets and connections on the blow-out preventer and associated piping and valves on the pre-assembled equipment prior to installation on the well-head.

20. A method according to claim 13 wherein the preassembled equipment is orientated in a substantially horizontal alignment for mobile transport.

* * * * *